US005864204A

United States Patent [19]

Ihm

[11] Patent Number: 5,864,204

[45] Date of Patent: Jan. 26, 1999

[54] SUPPLEMENTARY COIL OF DEFLECTION YOKE FOR BRAUN TUBE

[75] Inventor: Jong Ho Ihm, Daegu-si, Rep. of Korea

[73] Assignee: LG Electronics, Inc., Rep. of Korea

[21] Appl. No.: 756,799

[22] Filed: Nov. 26, 1996

[30] Foreign Application Priority Data

Nov. 30, 1995 [KR] Rep. of Korea ..... 1995-45911

[51] Int. Cl.[6] ..... H01J 29/70

[52] U.S. Cl. ..... 313/440; 313/413; 313/431; 313/432; 335/210; 335/211; 335/212; 335/213

[58] Field of Search ..... 313/440, 413, 313/431, 433; 335/210, 211, 212, 213

[56] References Cited

U.S. PATENT DOCUMENTS 5,412,362 5/1995 Ikeuchi ..... 335/213

5,519,371 5/1996 Ogawa et al. ..... 313/440

5,598,055 1/1997 Inoue et al. ..... 313/440

*Primary Examiner*—Ashok Patel

*Assistant Examiner*—Matthew J. Gerike

*Attorney, Agent, or Firm*—Fish & Richardson PC

[57] ABSTRACT

Disclosed is a supplementary coil of a deflection yoke for a Braun tube. The supplementary coil forms a magnetic field of a pin-cushion type at a screen portion and a magnetic field of a barrel type at a neck portion at the same time. The deflection yoke includes a coil separator for fixing a relative position between horizontal deflection coils and vertical deflection coils by acting as an insulator. The supplementary coil also includes projections formed on inside surfaces of the neck portion and the screen portion of the coil separator. The supplementary coil is wound around the projections in the neck portion in a winding direction identical to a winding direction of the horizontal coil and wound around the projections in the screen portion in a winding direction opposite to the winding direction of the horizontal coil.

6 Claims, 6 Drawing Sheets

SUPPLEMENTARY COIL OF DEFLECTION YOKE FOR BRAUN TUBE

BACKGROUND OF THE INVENTION

1. Field of the Invention

The present invention relates to a deflection yoke for a Braun tube and, more particularly, to a supplementary coil of a deflection yoke for a Braun tube which can form a magnetic field of a pin-cushion form at a screen part and a magnetic field of a barrel form at a neck part at the same time.

2. Discussion of the Related Art

FIG. 1 illustrates a section of a Braun tube schematically showing a mounting position of a conventional deflection yoke.

Referring to FIG. 1, the Braun tube includes a panel 1 forming a front face of the Braun tube and a funnel 2, a front portion of which is melt bonded to the panel 1. The funnel 2 has a convergent portion with a neck part 2*a* formed at an end thereof. An electron gun 4 is provided in the neck part 2*a* for emitting electron beams 3 toward the panel 1, and deflection yokes 7 are provided on an outer circumference of the funnel 2 for deflecting the electron beams 3 to predetermined spots. Red, green and blue fluorescent material layers 5 of dot or stripe forms are coated on inside surfaces of the panel 1, and a shadow mask 6 is spaced a predetermined distance apart from the fluorescent material layers 5 in an inner side of the panel 1. Numerous minute holes are provided in the shadow mask 6 for selective passing of the electron beams 3. Each of the electron beams 3 passed through the shadow mask 6 collides on the fluorescent material layers 5 to reproduce colors on the surface of the panel 1.

FIG. 2 is a perspective view of the conventional deflection yoke shown in FIG. 1.

Referring to FIG. 2, the deflection yoke 7 includes vertical deflection coils 9 for deflecting the electron beams 3 in a vertical direction, and horizontal deflection coils 8 (disposed on either side of the pusher part G) for deflecting the electron beams 3 in a horizontal direction, and a coil separator 10 for supporting the vertical and horizontal deflection coils 9 and 8, by acting as an insulator between the coils 9 and 8, and fixing a relative position between the funnel 2 and the vertical and horizontal deflection coils 9 and 8. The horizontal deflection coils 8 are, in most cases, wound in saddle forms and assembled into the coil separator 10, or wound in leading grooves(not shown) formed inside of the coil separator 10 for winding the horizontal deflection coils directly.

FIG. 3 illustrates a half section of the conventional coil separator 10 shown in FIG. 2, FIGS. 4A–4C illustrate different forms of magnetic fields each formed by the horizontal deflection coils wound on an inner circumferential surface of the coil separator 10 shown in FIG. 3, where FIG. 4A illustrates a barrel type magnetic field, FIG. 4B illustrates a pin cushion type magnetic field, and FIG. 4C illustrates a uniform magnetic field.

Referring to FIG. 3, of the deflection yokes 7, it is known that a neck part 10*a* with reference to a middle portion 10*b* of the coil separator 10 of the saddle type horizontal deflection coils 8 has an influence on convergence of the electron beams and a screen part 10*c* has an influence on distortions of the electron beams. The magnetic fields that the horizontal deflection coils 8 should form in each portion of the coil separator for an excellent convergence and prevention of distortions are shown in FIGS. 4A–4C. FIG. 4A illustrates a weak barrel type magnetic field 11, FIG. 4C illustrates a uniform magnetic field 12 in the neck part 10*a* shown in FIG. 3, and FIG. 4B illustrates a pin cushion type magnetic field 13 of an appropriate strength in the middle portion 10*b* shown in FIG. 3, or a strong pin cushion type magnetic field 13 in the screen part 10*c* shown in FIG. 3.

In order to form the foregoing magnetic fields, in winding coils from the neck part 10*a* to the middle portion 10*b*, either a supplementary coil(not shown) is wound at the inner screen part 10*c* or a groove is formed on middle of the coil for forming a coil distribution which has discontinuity in the continuous winding of coil between the neck part 10*a* and the middle portion 10*b* of the horizontal deflection coils 8. If appropriate magnetic fields can not be formed with the aforementioned winding, the winding pattern on which the coil is wound is either claded by welding or grinded before winding the coil to form a desired magnetic field.

In the meantime, in case of a slit type horizontal deflection coil(not shown), which is another form of the saddle type coil, the coil is wound along a groove formed in the coil separator to form a portion of the magnetic field between the neck part 10*a* to the screen part 10*c* in which the magnetic field has a sudden change.

However, the deflection yokes of saddle type or slit type horizontal deflection coils have the following problems.

In case of the saddle type horizontal deflection coil 8, since the coil can not be wound to pass many different portions with respect to angles in winding the coil from the neck part 10*a* to the screen part 10*c*, distribution of the winding can not be formed with variety. In order to adjust a portion of the winding distribution of the horizontal deflection coil 8, though pins are provided in the screen part 10*c* and the neck part 10*a*, distribution in the middle portion 10*b* with which a convergence can be greatly adjusted can not be adjusted without restraint.

Therefore, in case it is intended to produce a winding of a general saddle type coil 8 of a desired characteristic, separate additional measures, such measures as attachment of a helper(not shown) together with the supplementary coil, cladding by welding or grinding of the winding pattern for discontinuity of the pattern, or adjustment of the winding distribution by pusher, is required.

Though the slit type horizontal coil has an advantage in free adjustment of the winding distribution, it has a disadvantage of taking too much time in production.

SUMMARY OF THE INVENTION

Accordingly, the present invention is directed to a supplementary coil of a deflection yoke for a Braun tube that substantially obviates one or more of the problems due to limitations and disadvantages of the related art.

An object of the present invention is to provide a supplementary coil of a deflection yoke for a Braun tube which can form magnetic fields which are required at a neck part and a screen part at the same time.

Additional features and advantages of the invention will be set forth in the description which follows, and in part will be apparent from the description, or may be learned by practice of the invention. The objectives and other advantages of the invention will be realized and attained by the structure particularly pointed out in the written description and claims, as well as the appended drawings.

To achieve these and other advantages and in accordance with the purpose of the present invention, as embodied and broadly described, the supplementary coil of a deflection yoke for a Braun tube, the deflection yoke having a coil separator for fixing a relative position between horizontal deflection coils and vertical deflection coils and acting as an insulator, includes a plurality of projections formed on inside surfaces of a neck part and a screen part of the coil separator, and a supplementary coil wound to run around the projections in the neck part in a winding direction identical to a winding direction of the horizontal coil and to run around the projections in a screen part in a winding direction opposite to the winding direction of the horizontal coil.

In other aspect of the present invention, there is provided a supplementary coil of a deflection yoke for a Braun tube, the deflection yoke having a coil separator for fixing a relative position between horizontal deflection coils and vertical deflection coils and acting as an insulator, including a supplementary coil holder for fitting on an inside surface of the coil separator and a supplementary coil, wherein the supplementary coil holder including, a neck part holder for fitting on the neck part, the neck part holder having a first groove around a peripheral surface thereof, a screen part holder for fitting on the screen part, the screen part holder having a second groove around a peripheral surface thereof, and a connecting holder for connecting the neck part holder and the screen part holder, the connecting holder having a third groove transverse to the first, and second grooves, and the supplementary coil being wound in the first groove of the neck part holer in a winding direction identical to the winding direction of the horizontal deflection coil and, in continuation to the above winding, in the second groove of the screen part holder in a winding direction opposite to the winding direction of the horizontal deflection coil via the third groove in the connecting holder.

It is to be understood that both the foregoing general description and the following detailed description are exemplary and explanatory and are intended to provide further explanation of the invention as claimed.

BRIEF DESCRIPTION OF THE DRAWINGS

FIG. 4A illustrates a barrel type magnetic field.

FIG. 4B illustrates a pin cushion type magnetic field.

FIG. 4C illustrates a uniform magnetic field.

DETAILED DESCRIPTION OF THE PREFERRED EMBODIMENTS

In the explanations for supplementary coils for deflection yoke for a Braun tube in accordance with first and second embodiments of the present invention shown in FIGS. 5A~7, identical reference numbers will be applied to parts which are identical to the conventional ones.

Figure 1:
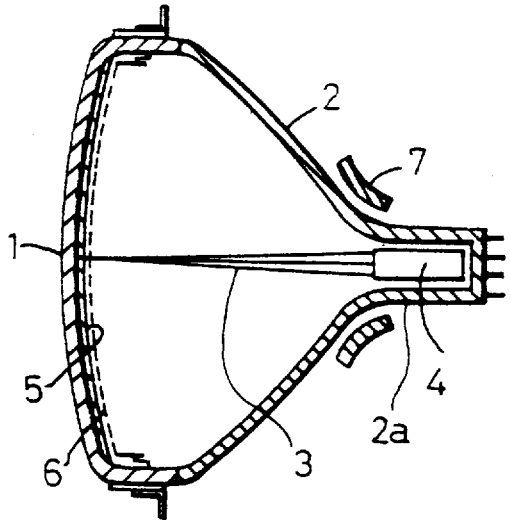
FIG.1 conventional art
FIG. 1 illustrates a section of a Braun tube schematically showing a mounting position of a conventional deflection yoke.
Figure 2:
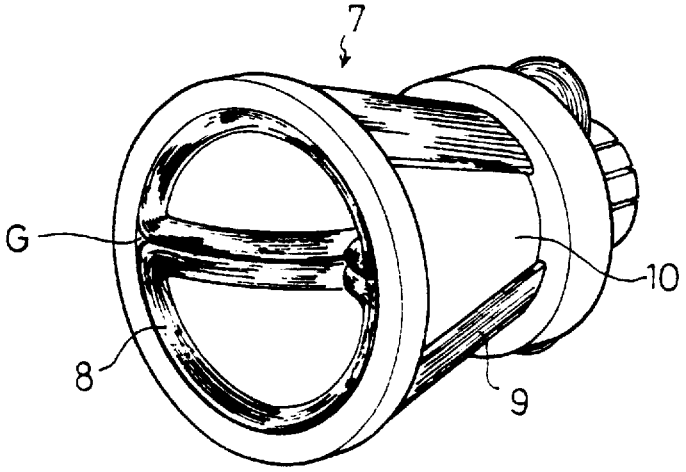
FIG.2 prior art
FIG. 2 is a perspective view of the conventional deflection yoke of FIG. 1.
Figure 3:
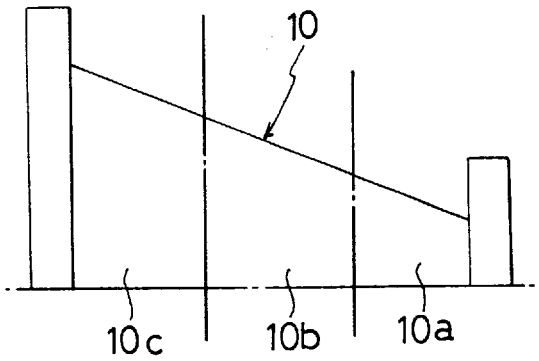
FIG.3 prior art
FIG. 3 illustrates a half section of the conventional coil separator of FIG. 2.
Figure 4A:
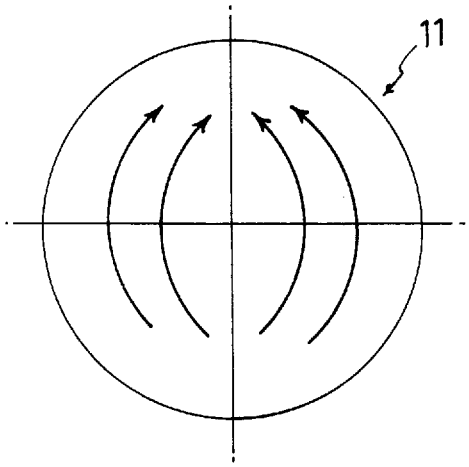
FIG.4A prior art
FIGS. 4A–4C illustrate different forms of magnetic fields each formed by the horizontal deflection coils wound on an inner circumferential surface of the coil separator of FIG. 3.
Figure 4B:
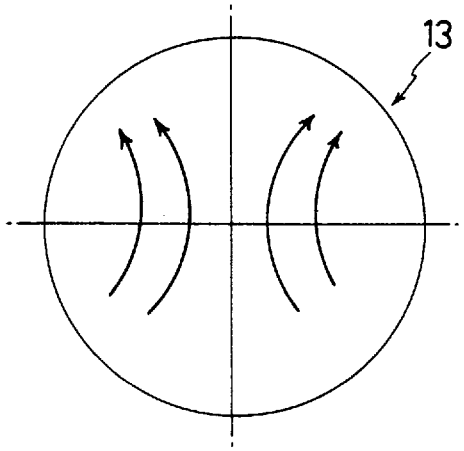
FIG.4B prior art
Figure 4C:
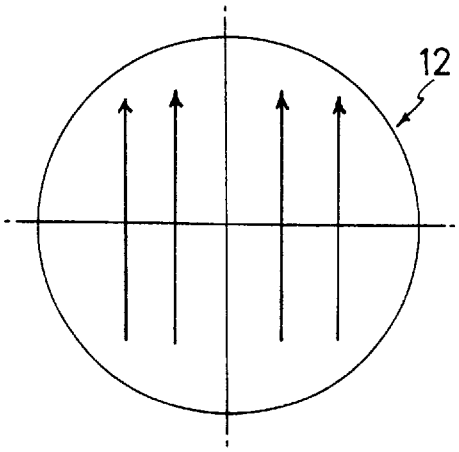
FIG.4C prior art
Figure 5A:
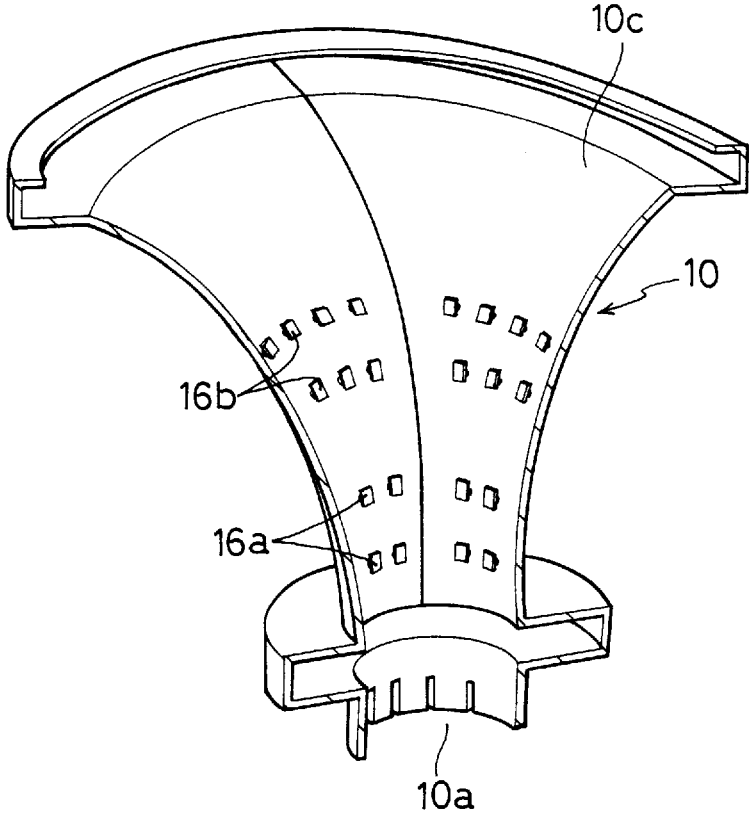
FIG. 5A illustrates a first embodiment of supplementary coil of a deflection yoke for a Braun tube.
Figure 5B:
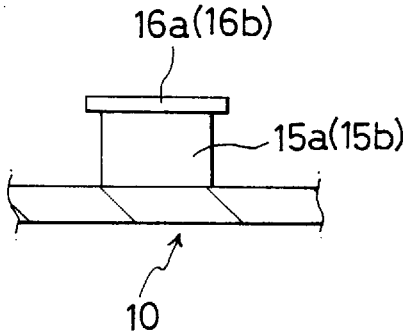
FIG. 5B illustrates a projection with a catch shown in FIG. 5A.
Figure 6:
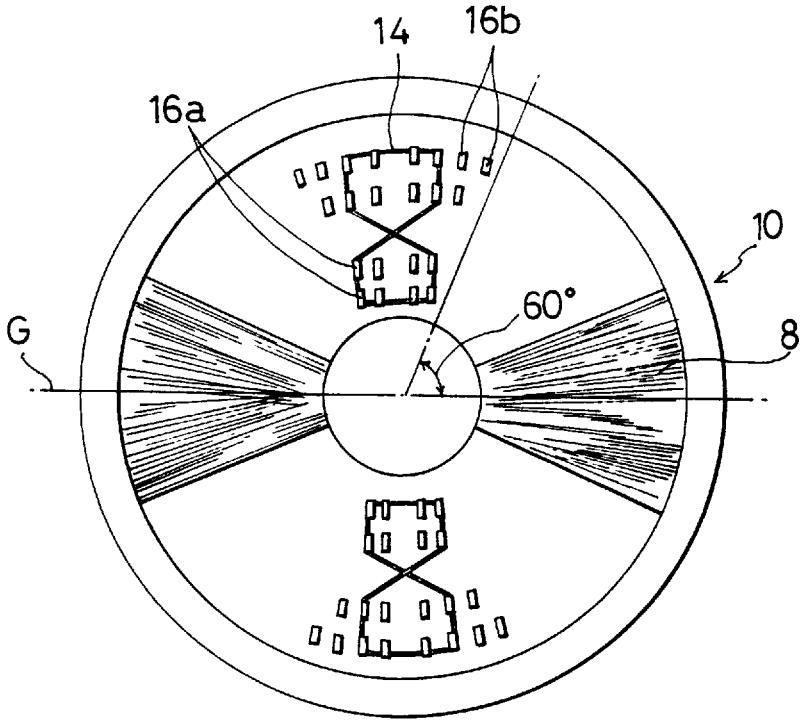
FIG. 6 illustrates a front view of a screen part of the supplementary coil of deflection yoke for a Braun tube of FIG. 5A.

FIG. 5A illustrates a supplementary coil of a deflection yoke for a Braun tube in accordance with a first embodiment of the present invention, FIG. 5B illustrates a detail of the projection with catch shown in FIG. 5A, and FIG. 6 illustrates a front view seen from the screen part of the supplementary coil of a deflection yoke for the Braun tube shown in FIG. 5A.

Referring to FIGS. 5A~6, the supplementary coil of a deflection yoke for a Braun tube includes a plurality of projections 16*a* and 16*b* attached on a screen part 10*c* and a neck part 10*a* of a coil separator 10 and a supplementary coil 14 wound around the projections 16*a* and 16*b*. Each of the projections 16*a* and 16*b* on the neck part 10*a* and the screen part 10*c* of the coil separator 10 has a catch 15*a*–15*b* at a free end thereof as shown in FIG. 5B for preventing the coil from being loosened from the projection.

In winding the supplementary coil in production of a deflection yoke, after assembly of the conventional saddle type horizontal deflection coils 8 inside of the coil separator 10, it is additionally required to wind the supplementary coil 14 around selected projections 16*a*, depending on a required adjustment, in the same winding direction as a winding direction of the horizontal deflection coil in the neck part 10*a* and to wind the supplementary coil 14 around selected projections 16*b*, depending on a required adjustment, in an opposite winding direction to a winding direction of the horizontal deflection coil in the screen part 10*b*, i.e., in an opposite winding direction of the supplementary coil in the neck part 10*a*, to form a form similar to 8.

In the meantime, as a barrel type magnetic field is formed when a center of gravity of a coil distribution of the supplementary coil 14 falls on a point positioned greater than ±60° with reference to a pusher part G, at which the angle is taken as 0°, and a pin cushion type magnetic field is formed when the center of gravity falls on a point positioned smaller than ±60° with reference to a pusher part G, each of the projections 16*a* and 16*b* in the neck part 10*a* and the screen part 10*c* of the coil separator 10 are formed at a position greater than ±60°. Accordingly, with the barrel type magnetic field formed in the neck part 10*a* by the supplementary coil 14 therein and the strong pin cushion type magnetic field formed in the screen part 10*c* by the supplementary coil 14 formed therein wound opposite to the winding direction of the supplementary coil 14 formed in the neck part 10*a*, an adjustment of distortion and an excellent convergence can be accomplished in a place where an extreme change of coil distribution is required. The coil distribution in the aforementioned explanation means a distribution of a coil section wound in the deflection yoke, which is designed appropriately according to the position of the deflection yoke.

Figure 7:
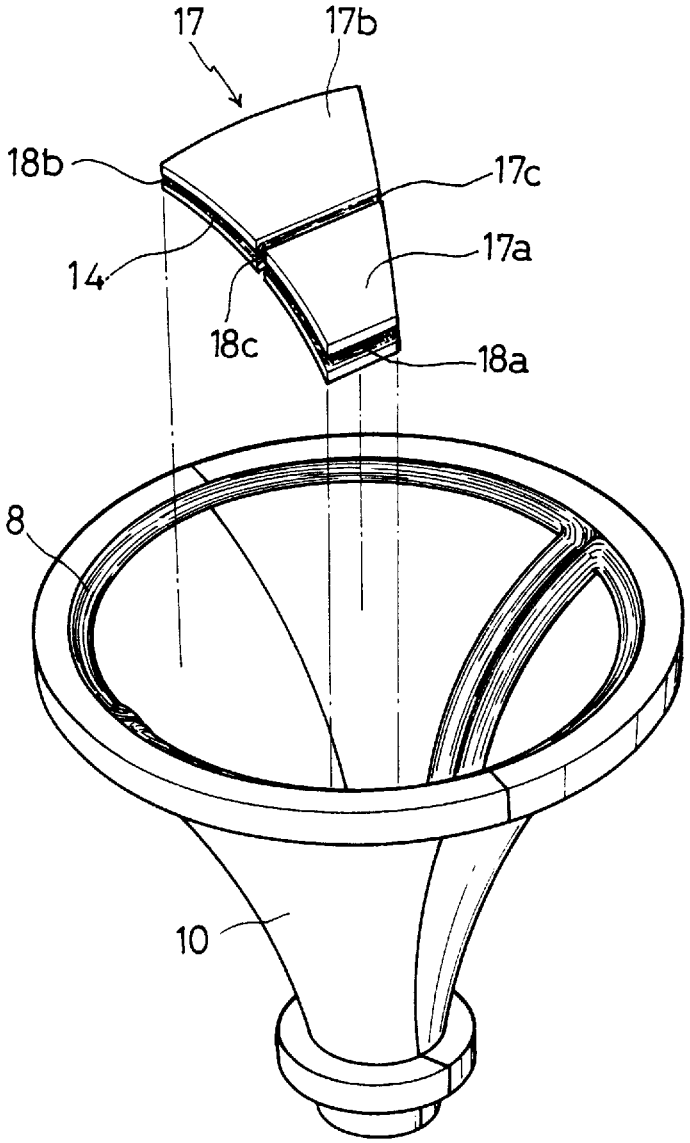
FIG. 7 illustrates a second embodiment of a supplementary coil holder assembled on the coil separator for a supplementary coil of deflection yoke for a Braun tube.

FIG. 7 illustrates a supplementary coil holder assembled on the coil separator for a supplementary coil of deflection yoke for a Braun tube in accordance with a second embodiment of the present invention.

The supplementary coil holder 17, formed of an insulative material to be fixed on an inside surface of the coil separator 10, includes a neck part holder 17*a* for fitting on the neck part 10*a* having a groove 18*a* around a peripheral surface thereof, a screen part holder 17*b* for fitting on the screen part 10*c* having a groove 18*b* around a peripheral surface thereof, and a connecting holder 17*c* for connecting the neck part holder 17*a* and the screen part holder 17*b* having a groove

18*c* transverse to the grooves 18*a* and 18*b*. Similar to the first embodiment, a width of the supplementary coil holder 17 is limited so that the supplementary coil holer 17 can be placed within a range greater than ±60° of the coil separator 10 with reference to the pusher part, an angle at which is taken as 0°.

The supplementary coil 14 is wound in the groove 18*a* of the neck part holer 17*a* in a winding direction identical to the winding direction of the horizontal deflection coil 8 and, in continuation to the above winding, in the groove 18*b* of the screen part holder 17*b* in a winding direction opposite to the winding direction of the horizontal deflection coil 8 via the groove 18*c* in the connecting holder 17*c*, to form a horizontal deflection coil 8 similar to the first embodiment. According to this, a barrel type magnetic field is formed in the neck part 10*a* and a pin-cushion type magnetic field is formed in the screen part 10*c*.

In the meantime, though the supplementary coil holder 17 may be shaped as necessary, it is preferable to form the profile of the holder 17 to match with the inside profile of the coil separator 10.

The second embodiment supplementary coil of a deflection yoke for a Braun tube having the aforementioned configuration has an advantage in easily winding the coil since the winding can be done away from the coil separator, in addition to the following advantages of the present invention.

First, since the extreme change of winding form of the horizontal deflection coil can be avoided, productivity of the winding process can be increased significantly.

Second, since the distribution of the supplementary coil can be varied partly thereby, eliminating the necessity for a helper, a number of required components can be reduced, and the time for designing the deflection yoke can be shortened resulting to shorten the lead time for development of the deflection yoke.

It will be apparent to those skilled in the art that various modifications and variations can be made in the supplementary coil of a deflection yoke for a Braun tube of the present invention without departing from the spirit or scope of the invention. Thus, it is intended that the present invention cover the modifications and variations of this invention provided they come within the scope of the appended claims and their equivalents.

What is claimed is:

1. A supplementary coil of a deflection yoke for a Braun tube, the deflection yoke having a coil separator for maintaining a relative position between horizontal deflection coils and vertical deflection coils by functioning as an insulator, the supplementary coil comprising:

a plurality of projections formed on inside surfaces of a neck portion and a screen portion of the coil separator; and a supplementary coil wound around the projections in the neck portion in a winding direction identical to a winding direction of the horizontal coil and wound around the projections in the screen portion in a winding direction opposite to the winding direction of the horizontal coil.

2. The supplementary coil of claim 1, wherein the projections are formed on a surface of the coil separator that is positioned greater than ±60° with reference to a pusher part, wherein an angle of the pusher part is 0°.

3. The supplementary coil of claim 1, wherein each of the projections includes a catch at an end thereof.

4. A supplementary coil of a deflection yoke for a Braun tube, the deflection yoke having a coil separator for maintaining a relative position between horizontal deflection coils and vertical deflection coils by functioning as an insulator, the supplementary coil comprising:

a supplementary coil;

a supplementary coil holder for fitting on an inside surface of the coil separator, wherein the supplementary coil holder includes:

a neck part holder for fitting on a neck part, the neck part holder having a first groove around a peripheral surface thereof, a screen part holder for fitting on a screen part, the screen part holder having a second groove around a peripheral surface thereof, and a connecting holder for connecting the neck part holder and the screen part holder, the connecting holder having a third groove transverse to the first and second grooves, wherein the supplementary coil is wound: in the first groove of the neck part holder in a winding direction identical to the winding direction of the horizontal deflection coil, through the third groove in the connecting holder, and in the second groove of the screen part holder in a winding direction opposite to the winding direction of the horizontal deflection coil.

5. The supplementary coil of claim 4, wherein a width of the supplementary coil holder is limited such that the supplementary coil holder can be placed within a range greater than ±60° of a surface of the coil separator with reference to a pusher part of the horizontal deflection coil, wherein an angle of the pusher part is 0°.

6. The supplementary coil of claim 2, wherein each of the projections includes a catch at an end thereof.

* * * * *